United States Patent [19]

Purfurst

[11] Patent Number: 4,593,560

[45] Date of Patent: Jun. 10, 1986

[54] PUSH-OFF PISTONS

[75] Inventor: Ernest H. Purfurst, Houston, Tex.

[73] Assignee: Halliburton Company, Duncan, Okla.

[21] Appl. No.: 725,955

[22] Filed: Apr. 22, 1985

[51] Int. Cl.[4] ..... E21B 49/00

[52] U.S. Cl. ..... 73/155

[58] Field of Search ..... 73/151, 152, 153, 155; 175/50, 58, 59; 166/100, 264

[56] References Cited

U.S. PATENT DOCUMENTS

| | | | |
|---|---|---|---|
| B 407,736 | 1/1975 | Urbanosky | 73/155 |
| 3,577,783 | 5/1971 | Whitten et al. | 73/152 |
| 3,724,540 | 4/1973 | Urbanosky et al. | 166/100 |
| 4,292,842 | 10/1981 | Hallmark | 73/155 |
| 4,375,164 | 3/1983 | Dodge et al. | 73/154 |
| 4,434,653 | 3/1984 | Montgomery | 73/151 |

*Primary Examiner*—Stewart J. Levy
*Assistant Examiner*—Robert R. Raevis
*Attorney, Agent, or Firm*—W. J. Beard

[57] ABSTRACT

In a formation tester having a snorkel extending laterally for penetration of a formation, differential sticking may occur. In the preferred embodiment, the snorkel is surrounded by a seal ring and a resilient pad around the snorkel. The present invention includes upper and lower, evenly spaced push-off pistons. They are extendable parallel to the snorkel to push the tool body away from the wall of the borehole. The pistons extend piston rods supporting end located pads to enable breaking of differential sticking on retraction of the snorkel.

8 Claims, 2 Drawing Figures

CONTROLS
22
18
20
24
POWER SUPPLY
RECORDER
26
28
14
16
12
10
56
52
54
50
40
42
38
30
44
36
34
32
48
60
64
62
66
13

54
50
56
30
74
34
36
72
32
76
68
TOOL HYDRAULIC SYSTEM
86
70
78
84
80
82

PUSH-OFF PISTONS

BACKGROUND OF THE DISCLOSURE

After an oil well has been partly drilled and suspected producing formations have been penetrated, it is necessary to make various tests to determine production possibilities of various formations. One of the test techniques involves the use of a tool which is known as a formation tester. One exemplary formation tester is set forth in U.S. Pat. No. 4,375,164 assigned to assignee of the present disclosure. As set forth in that disclosure, the tool is adapted to be lowered into the well bore, supported on an armored logging cable enclosing certain conductors for providing surface control for the tool. The logging cable extends to the surface and passes over a sheave and is spooled on a reel or drum. The conductors in it connect with suitable surface located power supplies, controls, and recorder. The formation tester is lowered to a specified depth in a well. At that elevation, a backup shoe is extended on one side of the formation tester and formation testing apparatus is extended diametrically opposite into the formation of interest. The equipment so extended normally includes a surrounding elastromeric sealing pad which encircles a smaller extendable snorkel which penetrates a formation as the formation will permit, up to a specified depth. The snorkel is ideally isolated from fluid and pressure in the well to be able to test the formation. The snorkel is extended into the formation to enable direct fluid communication from the formation into the tool. Moreover, it is isolated from invasion of the well borehole and pressures therein to permit a pressure sensor to obtain formation pressure. Further, a sampling chamber elsewhere in the formation tester can be selectively connected through the snorkel by suitable valves to obtain delivery of a fluid sample from the formation. The fluid sample typically may include a relatively small sample which is a pretest sample, and if that is acceptable, a larger sample can be drawn through the snorkel. Various pretest and sample volumes are selected and determined under control from the surface. As will be understood, the tool body is typically only a few inches in diameter (depending on hole size) and thus is not able to store substantial quantities of formation fluid. Thus, a sample is taken, the storage chambers therein filled, and the formation tester is retrieved.

Other measurements can be made including various and sundry tests for formation permeability. Ideally, such measurements are obtained isolated from the intrusion of the well borehole. One of the factors resulting from the intrusion of the well borehole is the drilling fluid which is routinely used to conduct well drilling operations. It is normally identified as drilling mud. In the well borehole, the mud forms a mud cake against the side wall of the drilled hole. This helps isolate the various formations. The drilling mud thus packs against the side wall and the liquid in the drilling mud may penetrate relatively deep into the adjacent formations while the solid particles in the drilling mud form a filtrate cake. This cake tends to be somewhat dry as a result of the loss of liquid therein by filtration into the adjacent formations.

When the formation test procedure is terminated, the equipment extended from the formation tester is retracted. Thus, the snorkel is pulled in and the seal around the elastomeric gasket is normally broken equalizing the pressures surrounding the pad. The backup shoes extended on the opposite side are also retracted. Typically, this procedure occurs with the formation tester (normally, a elongate cylindrical body) pressed against one side of the borehole formation. There is a possibility of pressure differential sticking of the sealing pad, or even the cylindrical body. A representative sticking problem is discribed in U.S. Pat. No. 3,724,540. There, differential pressure sticking is set forth as a retreival problem. Differential sticking arises from the circumstance wherein pressure in the well is greater than the formation pressure. When the sealing pad is pressed against the filtrate cake, the hydrostatic pressure of the well fluids in the borehole might be sufficiently greater to hold the sealing pad against the mud cake. Assume, for instance, that the pressure in the adjacent formation is somewhat less than the pressure in the borehole. If this occurs, the sealing pad and snorkel is held against the mud cake, even embedding into it, and it may be held so tightly that it cannot be retracted. The sticking problem may act on the sealing pad and tool body both. The full retraction of the sealing pad and snorkel may not break the sealing force; if so, the tool body is held against retreival. Even worse, the sticking may hold the entire tool body.

One way to dislodge the formation tester is to simply lift up on the logging cable which supports the formation tester. This, however, runs the risk of breaking the cable because the vertical lifting force required is extreme compared to the normal operating loads placed on the logging cable. The total surface area exposed to differential sticking can be substantial and accordingly, the axial load required to pull the tool free is quite great.

U.S. Pat. No. 3,724,540, is an apparatus for disengaging the formation tester from the borehole wall. By contract, this disclosure sets forth push-off pistons which are located above and below the sealing pad and snorkel to extend simultaneously towards the adjacent formation with a view of breaking differential sticking which holds the body against the formation. The push-off pistons are maintained at a normally retracted position. They incorporate piston rods extending laterally of the tool body which support large thrust pads for wide footing when they extend. The piston rods are connected with suitable pistons in the hydraulic cylinders within the tool body. The tool hydraulic system is utilized to provide hydraulic power for extending the push-off pistons whereby differential sticking is thus broken. This is particularly beneficial because it aids in overcoming the sticking force on snorkel retraction.

With this in view, the present invention is thus summarized as a formation tester having push-off pistons, preferably two with one located above and the other located below the snorkel, the push-off pistons being powered by the tool hydraulic system for the purpose of pushing the tool body away from the formation to thereby break the differential sticking.

Further objects and advantages of the present disclosure will become more relatively apparent upon consideration of the discription of the preferred embodiment in conjunction of the drawings described below.

DETAILED DESCRIPTION OF THE PREFERRED EMBODIMENT

Figures 1, 2:
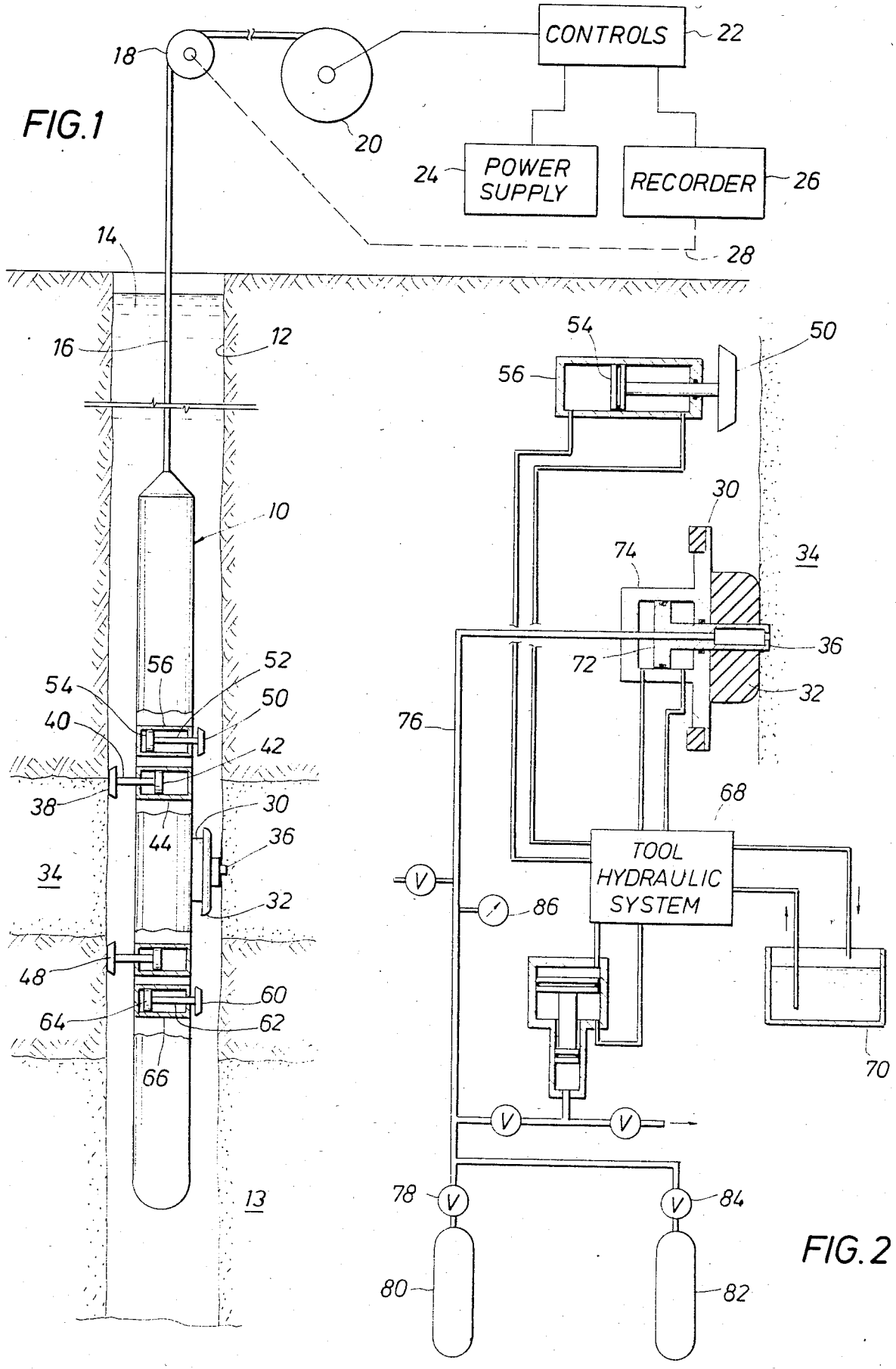
FIG. 1 shows a formation tester suspended in a well borehole for conducting a test wherein the snorkel is extended into the formation and backup shoes support the formation tester for conducting the test, and further including push-off pistons for breaking differential sticking.
FIG. 2 is a hydraulic schematic showing operation of the push-off pistons and snorkel apparatus included in the formation tester.

Attention is first directed to FIG. 1 of the drawings where the numeral 10 identifies a formation tester constructed in accordance with the teaching of this disclosure. It is supported in a well borehole 12 which is shown to be open hole. The tool 10 typically operates by testing a formation penetrated by open borehole and to this end, no casing has been shown in FIG. 1. Typically, the well is filled with drilling fluid which is known as drilling mud, and the column of drilling mud is identified at 14. The formation tester 10 comprises in an elongate cylindrical body of substantial length and weight. It is supported on an armored cable known as a well logging cable. Suitable electrical conductors are enclosed in the cable, the cable being identified by the numeral 16. The cable extendes to the surface and passes over a sheave 18. The cable 18 is stored on a drum 20. The cable might be several thousand feet in length to test formations at great depths. Conductors from the cable 16 are connected with various and sundry controls identified at 22. The electronic control equipment for the formation tester is provided with power from a power supply 24. The signals and data obtained from the formation tester 10 are output through the surface located equipment and to a recorder 26. The recorder records the data as a function of depth. An electronic or mechanical depth indicating mechanism is connected to the sheave 18 and provides depth measurement to the recorder 26 and is thus identified by the numeral 28.

Refering now to the tool body, it will be first observed that it supports a laterally extending probe which is identified by the numeral 30. The probe 30 has a piston which extends it from the tool body. The extended probe is surrounded by a ring of elastomeric material 32. The ring 32 is a seal pad. It is pliable, and is affixed to the probe 30 for sealing operation. Moreover, the ring 32 operates as a seal when pressed against the adjacent formation. Assume the formation 34 adjacent to the tool is suspected to have fluids of interest. This formation 34 is to be tested by extending a snorkel 36 into the formation. The probe 30 is extended against the formation. When the seal 32 is pressed against the formation 34, the seal prevents invasion of open hole pressure or drilling fluids into the vicinity of the extended snorkel 36. It is important to isolate the snorkel tip from the invading fluids or pressure so that data obtained from the formation 34 is unmodified by the intrusion of the well borehole.

This sequence of operation involving extension of the snorkel 36 into the formation typically occurs after backup shoes and the sealing pad are positioned, and an equalizing valve in the tester is closed. The numeral 38 identifies a top backup shoe which is supported on a piston rod 40. The piston rod 40 extends diametrically opposite the snorkel 36. The snorkel 36 extends on one side of the tool body while the backup shoe is on the opposite side. The piston rod 40 which supports the back up shoe is connected with a piston 42 in a hydraulic cylinder 44. The cylinder is preferably provided with hydraulic fluid from both ends so that the piston 42 is double acting; that is, the piston rod 40 is extended under power and retracted under power. As will be observed, the backup shoe 38 is above the snorkel 36. A similar backup shoe 48 is also included below the snorkel. Preferably, the backup shoes 38 and 48 are evenly spaced above and below the snorkel 36. Moreover, they are operated by hydraulic power simultaneously applied for extension of the probe 30. This assures that the seal 32 has loading on it to achieve the pressure seal to prevent intrusion of well fluids and pressure into the formation 34. The backup shoe 48 is supported on a similar piston rod and operates in the same fashion, preferably being connected and parallel with the other backup shoe so that the two operate together.

The foregoing sets forth the structure of the formation tester preliminary to a description of this improvement. As mentioned earlier, differential sticking is a real hazard in retreival of the formation tester. Differential sticking may be localized solely at the probe 30 and sealing pad 32, or may arise at additional locations. As the term is used herein, the location of the sticking area is not specifically limited to the probe 30 and sealing pad 32. To avoid differential sticking, or more accurately to break the hold resulting from differential sticking, the formation tester 10 is enhanced by push-off pistons. The upper push-off piston will be described first. It incorporates a shoe 50 supported on a piston rod 52. The piston rod is driven by a piston 54 which is enclosed in a hydraulic cylinder 56. The push-off shoe 50 extends in the same direction as does the snorkel 36. The piston rod 52 is parallel to the piston rod 40 for the backup shoe, the two extending in opposite directions. In like fashion, the lower push-off shoe 60 is supported on a piston rod 62 which is powered by a piston 64 in a hydraulic cylinder 66. The two push-off shoes 50 and 60 preferably operate simultaneously and are powered by the tool hydraulic system in parallel. Since they operate in parallel and are duplicate structures located above and below the snorkel 36, a description of one should suffice for both.

Attention is momentarily directed to FIG. 2. There, the hydraulic schematic of the formation tester 10 is shown is some detail. Briefly, there is a tool hydraulic system 68 which obtains hydraulic fluid from a sump 70 and returns fluid to the sump. Through suitable hydraulic lines, a piston 72 is operated within a cylinder 74 to extend the snorkel 36. The snorkel 36 is extended from the end of the probe 30 and penetrates the adjacent formation 34 to a depth determined by extension of piston rod connected to the piston 72. The snorkel 36 is hydraulically forced into the formation and is retracted under power, the piston and cylinder arrangement being a double acting system. While the snorkel is extended, fluid from the formation is delivered into a line connected from the snorkel 36. The line 76 connects through a suitable valve 78 into a storage container 80. A second storage container identified at 82 is also filled with fluid through the valve 84. The valves 78 and 84 are under control of the control system 22 located at the surface. Formation pressure is observed by a pressure measuring instrument 86. The hydraulic schematic FIG. 2 also includes the hydraulic cylinder 56 which powers the push-off shoe 50. Through the use of suitable hydraulic fluid lines, the piston 54 is driven in both directions by selective introduction of fluid under pressure at either end thereof. Moreover, this equipment is duplicated for the lower push-off piston. Thus, the tool hydraulic system 68 provides timed power for operation of the push-off pistons. In operation, the present formation tester is used in the following fashion. On lowering the formation tester to a depth adjacent the formation 34 of interest, the tool is then operated from the various controls 22 at the surface to begin the following sequence. The backup shoes 38 and 48 are extended on the back side. The pad surrounding the snorkel is extended to assure that the seal ring 32 forms a snug seal on formation 34. After expansion and assurance that the seal ring 32 has been seated against the wall, the snorkel 36 can then be extended. Because it is relatively narrow in diameter, it penetrates the formation 34 to some depth. At this depth, ideally only formation fluid and formation pressure is observed. The isolation obtained from operation of the formation tester assures that the formation tester holds a stationary position and enables testing without pressure or permeability error arising from formation fluid in the borehole.

The test may take a substantial time. All the while, the the formation tester seal 32 is pressed against the mud cake and may very well become embedded in it and held there by differential sticking. When the test is finished, the equalizer valve is opened and the backup shoes 38 and 48 are retracted. The snorkel 36 is retracted and the extended pad on the probe 30 is also retracted. Even after retraction, this may still leave the seal ring 32 or pad held against the sidewall by differential sticking. Accordingly, when the extended pad on the probe 30 is retracted, the push-off pistons are operated to force the push-off shoes 50 and 60 against the wall. By suitable sizing of the diameter of the pistons operating the push-off shoes and by application of adequate hydraulic pressure, a lateral force is applied to the entire tool body which forces it back towards the center of the open hole free of differential sticking. Breaking of the differential sticking can be verified by taking a strain on the logging cable 16. For instance, there typically will be a drop in the force required to lift the formation tester after the push-off shoes 50 and 60 have been extended. The force required to lift is momentarily tested either by lifting, and if the force indicates that differential sticking has ended, then the push-off shoes 50 and 60 are then retracted and the tool can then be safely retrieved.

In the preferred embodiment, equally spaced upper and lower push-off pistons are utilized. They are preferably angularly directed in the the same azimuth as the snorkel 36 to particularly assist in breaking the seal that is so desirable around the snorkel during operation. This operation enables the tool to break free for retreival, typically against any pressure differential which might cause sticking.

While the foregoing is directed at the preferred embodiment, the scope thereof is determined by the claims which follow.

What is claimed is:

1. For use on a logging cable in a formation tester adapted to be suspended in a well bore, apparatus comprising:

(a) an elongate fluid tight tool body sized and adapted for passage through a well borehole;

(b) a formation pressure testing snorkel capable of lateral extension from said tool body and adapted to be contacted against a formation of interest to obtain fluid and pressure test information about the formation;

(c) plural backup shoe members located on said tool body opposite said snorkel means and supported by said tool body, said plural shoe members being extendable to the formation wall opposite said snorkel means;

(d) seal means cooperative with the said snorkel for providing a sealing contact adjacent to said snorkel to isolate said snorkel from borehole pressure; and (e) dual push-off pistons located on the same side one above and one below said snorkel and supported by said tool body and adapted to move between a retracted position and an extended position, said push-off piston capable of extension in a direction to contact the formation adjacent said tool body for pushing said tool body away from the formation wall at the conclusion of a fluid and pressure test.

2. The apparatus of claim 1 wherein said apparatus includes said backup shoes which are supported on piston rods connected with pistons in hydraulic cylinders, and wherein hydraulic power is applied to said hydraulic cylinders for operation of said backup shoes.

3. The apparatus of claim 1 wherein said push-off pistons include an exposed contact shoe having a selected surface area for contact against the formation, an extendable piston rod connected thereto, a piston and cylinder for providing power to said piston rod for extension and retraction thereof.

4. The apparatus of claim 3 wherein said dual push-off pistons are spaced equally from said snorkel means.

5. A method of retrieving a formation tester from a well comprising the steps of:

(a) extending a snorkel means laterally from a tool body to conduct formation testing;

(b) sealing adjacent to said snorkel means to isolate borehole pressure from the formation;

(c) positioning upper and lower push-off means above and below said snorkel means on said tool body;

(d) after completing the formation testing, then extending at least one of said push-off means toward the formation to push the tool body away from the formation; and (e) retrieving the tool body on a logging cable.

6. The apparatus of claim 5 including the step of extending both of said push-off means.

7. The method of claim 6 including the step of operating said snorkel means for retraction simultaneously with extension of said push-off means.

8. The method of claim 7 including the preliminary step of first extending backup means to position the tool body prior to extending said snorkel means.

* * * * *